US008950994B2

(12) United States Patent
Tago et al.

(10) Patent No.: US 8,950,994 B2
(45) Date of Patent: Feb. 10, 2015

(54) PERFECT BINDING MACHINE

(75) Inventors: Shigeyoshi Tago, Shiga (JP); Shigeru Wakimoto, Shiga (JP)

(73) Assignee: Horizon International Inc., Shiga (JP)

( * ) Notice: Subject to any disclaimer, the term of this patent is extended or adjusted under 35 U.S.C. 154(b) by 81 days.

(21) Appl. No.: 13/978,614

(22) PCT Filed: May 23, 2011

(86) PCT No.: PCT/JP2011/061729

§ 371 (c)(1),
(2), (4) Date: Jul. 8, 2013

(87) PCT Pub. No.: WO2012/160633

PCT Pub. Date: Nov. 29, 2012

(65) Prior Publication Data

US 2013/0294868 A1 Nov. 7, 2013

(51) Int. Cl.

| | |
|---|---|
| ***B42C 11/00*** | (2006.01) |
| ***B42C 11/04*** | (2006.01) |
| ***B42C 5/00*** | (2006.01) |
| ***B42C 9/00*** | (2006.01) |
| ***B42C 19/02*** | (2006.01) |

(52) U.S. Cl.

CPC . *B42C 11/04* (2013.01); *B42C 5/00* (2013.01); *B42C 9/0025* (2013.01); *B42C 19/02* (2013.01)

USPC ..... 412/14; 412/4; 412/5; 412/11; 412/18; 412/19; 412/20; 412/21

(58) Field of Classification Search

CPC ..... B42C 11/00; B42C 11/04; G01B 7/00

USPC ..... 412/4–5, 11, 14, 18–21; 399/408; 270/58.09

See application file for complete search history.

(56) References Cited

U.S. PATENT DOCUMENTS

| | | | | |
|---|---|---|---|---|
| 4,767,250 | A * | 8/1988 | Garlichs | 412/11 |
| 7,722,306 | B2 * | 5/2010 | Yokobori et al. | 412/11 |

(Continued)

FOREIGN PATENT DOCUMENTS

| | | | |
|---|---|---|---|
| EP | 2127898 | A2 | 12/2009 |
| JP | 11-334244 | A | 12/1999 |

(Continued)

OTHER PUBLICATIONS

International Search Report for PCT/JP2011/061729, Mailing Date of Aug. 23, 2011.

(Continued)

*Primary Examiner* — Kyle Grabowski

(74) *Attorney, Agent, or Firm* — Westerman, Hattori, Daniels & Adrian, LLP

(57) ABSTRACT

A measurement unit (6) is provided with a fixed body (19) which is fixed on a base (17) and has a reference surface (19*a*). A movable body (21) slides in the base along a guide rail, and a measurement body (22) having a measuring surface (22*b*) slides in the movable body along the guide rail. The measurement body is always pressed against a first side wall (21*a*) of the movable body by a coil spring (24). A first sensor (27) to detect the time when a book body is located on the front side of the reference surface, and a second sensor (28) to detect the time when the measurement body is separated from the first side wall of the movable body by a predetermined distance, are provided.

13 Claims, 8 Drawing Sheets

A

B

(56) References Cited

U.S. PATENT DOCUMENTS

| | | | | |
|---|---|---|---|---|
| 2007/0170631 | A1 | 7/2007 | Kato et al. | |
| 2008/0308990 | A1 * | 12/2008 | Nochi et al. | 412/16 |
| 2009/0297297 | A1 * | 12/2009 | Katayama et al. | 412/14 |

FOREIGN PATENT DOCUMENTS

| | | | |
|---|---|---|---|
| JP | 2007-190744 | A | 8/2007 |
| JP | 2009-285906 | A | 12/2009 |

OTHER PUBLICATIONS

International Preliminary Report on Patentability (form PCT/IB/373) of PCT/JP2011/061729 dated Nov. 26, 2013, with form PCT/ISA/237, (5 pages).

* cited by examiner

A

B

A

B

A

B

C

PERFECT BINDING MACHINE

TECHNICAL FIELD

The present invention relates to a perfect binding machine comprising a conveying path, a series of binding units arranged along the conveying path for performing perfect binding, and at least one clamp unit movable along the conveying path, whereby the perfect binding is performed while a book block held between a pair of clamp plates of the clamp unit sequentially passes through the series of binding units.

BACKGROUND ART

A conventional perfect binding machine is provided with a conveying path, a series of binding units arranged along the conveying path for performing perfect binding, and at least one clamp unit movable along the conveying path. In this perfect binding machine, a book block, which consists of a plurality of sheets or signatures, is held between a pair of clamp plates of the clamp unit and then, while the book block is conveyed by the clamp unit along the series of binding units, the perfect binding is performed. Furthermore, in this perfect binding machine, the respective two or more binding units have a pair of members with which the book block is engaged at its both sides protruding from between the pair of clamp plates, a thickness measurement unit for measuring a thickness of the book block. Thus, prior to start of the perfect binding, the thickness of the book block is measured by the thickness measurement unit so that a gap between the pair of clamp plates and a gap between the pair of members of the respective binding units are adjusted based on the measured value of the thickness of the book block (See, for example, Patent Document 1).

FIG. 7 are perspective views schematically showing such perfect binding machine. Referring to FIG. 7, the perfect binding machine includes a conveying path F, a series of binding units (a milling unit B, an adhesive application unit C and a cover attachment unit D) which are arranged along the conveying path F for performing the perfect binding, a single clamp unit (in FIG. 7, only clamp plates 1*a*, 1*b* of the clamp unit are shown) arranged for reciprocal movement along the conveying path F, and a first drive mechanism (not shown) moving the clamp unit along the conveying path F.

When the perfect binding is started, at a book block insertion position A, a book block P is inserted between the pair of clamp plates 1*a*, 1*b* of the clamp unit and placed on a alignment plate 1*c* in such a manner that a back of the book block P faces downwardly. Then the book block P is held between the clamp plates and conveyed by the clamp unit toward the milling unit B along the conveying path F.

The milling unit B has a milling cutter 2*a* and a pair of guide plates 2*b*, 2*c*. While the book block P passes the milling cutter 2*a*, both sides of the book block P protruding between the pair of clamp plates 1*a*, 1*b* passes between the pair of guide plates 2*b*, 2*c*. Thus the back of the book block P is cut while the book block P is supported by the pair of guide plates 2*b*, 2*c* at the both sides thereof. After that, the book block P is conveyed to the adhesive application unit C by the pair of clamp plates 1*a*, 1*b*.

The adhesive application unit C has an adhesive tank 3*a* storing an adhesive, an adhesive applying roller 3*b*, and a roller 3*c* wiping off an excessive adhesive. The adhesive application unit C applies the adhesive of an appropriate thickness to the back of the book block P. When the application of adhesive is completed, the book block P is conveyed to the cover attachment unit D by the pair of clamp plates 1*a*, 1*b*.

The cover attachment unit D includes a bottom plate 4*c* and a pair of nip plates 4*a*, 4*b*. When the perfect binding is started, a printed cover Q is fed from a cover supply unit (not shown) onto the bottom plate 4*c* and the pair of nip plates 4*a*, 4*b* in a direction of an arrow S by an appropriate feed means such as a conveyor. Thereafter the book block P held between the pair of clamp plates 1*a*, 1*b* stops at a position where the back of the book block P is opposed to a corresponding back of the cover Q. Then the bottom plate 4*c* and the pair of nip plates 4*a*, 4*b* rise and the cover Q is pressed against the back of the book block P by the rising bottom plate 4*c* and at the same time, the movable nip plate 4*a* moves toward the stationary nip plate 4*b* so as to press the cover Q against the both sides of the book block P, thereby the cover Q is adhered to the book block P and a bound product is produced. After that, the clamp unit returns to the book block insertion position A, and the pair of clamp plates 1*a*, 1*b* open to a maximum extent to discharge the bound product.

The perfect binding machine includes a thickness measurement unit for measuring a thickness of the book block P. FIG. 8A is a plan view of the thickness measurement unit, and FIG. 8B is an elevation view of the thickness measurement unit shown in FIG. 8A.

As shown in FIG. 8A and FIG. 8B, the thickness measurement unit includes a base 40*a*, a pair of support members 40*b* fixed to the base 40*a* and spaced from each other, and a horizontal linear guide rail 40*c* extending between the support members 40*b* and supported by the support members 40*b*.

The thickness measurement unit further includes a slidable body 40*d* slidably mounted on the guide rail 40*c*. The slidable body 40*d* has a flat measuring surface 40*e* extending perpendicularly to the guide rail 40*c*.

The thickness measurement unit further includes a stationary body 40*f* fixed to the base 40*a*. The slidable body 40*d* slides in directions toward and away from the stationary body 40*f*, and the stationary body 40*f* has a flat reference surface 40*g* which is opposed to and able to make contact with the measuring surface 40*e* of the slidable body 40*d*.

The thickness measurement unit further has travel distance measurement unit for measuring a travel distance of the measuring surface 40*e* from the reference surface 40*g*. A zero point of the travel distance is established as a point at which the measuring surface 40*e* of the slidable body 40*d* contacts the reference surface 40*g* of the stationary body 40*f*. The travel distance measurement unit has a pair of pulleys 40*h*, 40*i* which are arranged at both ends of the guide rail 40*c* and attached to the base 40*a*, and an endless belt 40*j* extending between the pulleys 40*h*, 40*i*. The slidable body 40*d* is fixed to the endless belt 40*j*. The travel distance measurement unit further has a rotary encoder 40*k* coupled to a rotational shaft of the pulley 40*h*.

The thickness measurement unit is arranged adjacent to a table for jogging the book block P. The table is arranged adjacent to the book block insertion position A of the binding machine. In this case, the thickness measurement unit has an auxiliary table element 40*m* coupled to the table in such a manner that the auxiliary table element 40*m* is flush with the table. The auxiliary table element 40*m* is provided with a slot (not shown) extending along the guide rail 40*c*, the base 40*a* is fixed to a lower surface of the auxiliary table element 40*m*, at least the reference surface 40*g* of the stationary body 40*f* and the measuring surface 40*e* of the slidable body 40*d* protrude from an upper surface of the auxiliary table element 40*m* through the slot, and the measuring surface 40*e* is arranged for slide movement.

Prior to start of the binding operation of the binding machine, the book block P is jogged on the table by the operator and then, inserted between the reference surface 40*g* and the measuring surface 40*e* of the thickness measurement unit.

Next, the operator supports the book block P in a standing position with his (or her) one hand and slides the slidable body 40*d* toward the stationary body 40*f* with his (or her) other hand, so that the book block P is pressed by the measuring surface 40*e* of the slidable body 40*d* against the reference surface 40*g* of the stationary body and a thickness of the book block P is measured.

On the basis of the obtained measured value, a gap between the pair of clamp plates 1*a*, 1*b* before holding a book block, a gap between the pair of guide plates 2*b*, 2*c* of the milling unit B, a gap between a pair of laterally adhesive applying rollers 3*c*, 3*d* of the adhesive application unit C, a gap between the pair of nip plates 4*a*, 4*b* of the cover attachment unit D, and a gap between a pair of crease forming rollers 5*a*, 5*b* of a cover feeding unit E are adjusted by a control unit so that these gaps are adapted to the thickness of the book block P.

However, in such perfect binding machine, at measurement of the thickness of the book block P, the operator has to keep the book block P in the standing state with his (or her) one hand, while moving the slidable body 40*d* with his (or her) other hand. Consequently, in manufacturing various kinds of bound products in small quantities, the measurement of the thickness consumes a lot of time, which leads to low productivity. Further, for a thick book block P, it is difficult for the operator to support the book block P in a standing position only with his (or her) one hand and therefore, he (or she) often loosed the book block P while moving the slidable body 40*d* with his (or her) other hand, so that he (or she) had to restart the measurement from the beginning. Thus, the measurement of the thickness was burdensome for the operator.

In addition, it is necessary to press the book block P against the stationary body 40*f* with the slidable body 40*d* on measuring the thickness. However, the pressing force is not uniform because the book block P is manually pressed. Consequently, for a thick book block P, it is not possible to sufficiently remove air from the book block P, so that a measurement error increases, which leads to reduction in quality of the bound product.

PRIOR ART DOCUMENTS

Patent Documents

Patent Document 1: EP 2127898 A2

SUMMARY OF THE INVENTION

Problems to be Solved by the Invention

It is an object of the present invention to achieve easy, fast and highly accurate measurement of the thickness of a book block in a perfect binding machine.

Means for Solving the Problems

In order to achieve this object, according to the present invention, there is provided a perfect binding machine comprising: a conveying path; a series of binding units arranged along the conveying path for performing perfect binding; at least one clamp unit movable along the conveying path; a first drive mechanism moving the clamp unit along the conveying path, the perfect binding being performed while a book block held between a pair of clamp plates of the clamp unit sequentially passes through the binding units, the respective two or more binding units including a pair of members with which the book block is engaged at both sides thereof protruding from between the pair of clamp plates, and a gap adjusting unit moving the pair of members in directions toward and away from each other; a first control unit controlling the clamp unit and the gap adjusting unit; and a thickness measurement unit measuring a thickness of the book block, wherein before start of the perfect binding, the thickness of the book block is measured by the thickness measurement unit, and the gap between the pair of clamp plates and the gap of the respective pair of members are adjusted by the first control unit based on the measured value of the thickness. The thickness measurement unit includes: a base having an upper surface on which the book block is placed; a stationary body attached to the upper surface of the base and having a reference surface perpendicular to the upper surface; a guide rail attached to the base and extending perpendicularly to the reference surface; a movable body mounted on the guide rail for slide movement in directions toward and away from the stationary body; and a second drive mechanism sliding the movable body along the guide rail, the movable body having two surfaces which are spaced from each other in a direction of an axis of the guide rail, a space being formed between the two surfaces. The thickness measurement unit further includes: a measuring body arranged in the space of the movable body and mounted on the guide rail for slide movement between the two surfaces, and having a measuring surface opposed to the reference surface of the stationary body; one or more elastic biasing members arranged between the movable body and the measuring body for constantly pressing the measuring body against a surface closest to the stationary body of the two surfaces; a first sensor attached to the base or the stationary body so as to detect a time when the book block is placed in front of the reference surface of the stationary body; a second sensor attached to the movable body, or the measuring body, or the both so as to detect a time when the measuring body is separated from the surface closest to the stationary body by a predetermined distance against an elastic force of the elastic biasing member; a travel distance measurement unit measuring a travel distance of the measuring surface from the reference surface, a zero point of the travel distance being established as a point at which the measuring surface of the measuring body contacts the reference surface of the stationary body; and a second control unit controlling the second drive mechanism and the travel distance measurement unit. When the first sensor outputs a detection signal, the movable body further slides toward the stationary body after the measuring surface of the measuring body comes into contact with the book block so as to press the book block against the reference surface and then, when the second sensor outputs a detection signal, the movable body stops and the measurement is performed by the travel distance measurement unit to obtain the thickness of the book block.

According to a preferred embodiment of the present invention, the elastic biasing member of the thickness measurement unit is a coil spring.

According to another preferred embodiment of the present invention, the first sensor is a photoelectric sensor, and the second sensor is a proximity sensor.

According to still another preferred embodiment of the present invention, the base includes an upper wall and an interior space formed below the upper wall, the upper wall forming the upper surface, the guide rail being arranged in the interior space. The movable body includes first and second side walls which form the two surfaces, and a connecting wall connecting upper ends of the first and second side walls to each other, each of the first and second side walls having an opening for inserting the guide rail therethrough. The measuring body has a through hole for inserting the guide rail therethrough. The movable body is arranged in the interior space of the base, the measuring body is arranged in the space of the movable body, the movable body and the measuring body are slidably mounted on the guide rail through the opening and the through hole, respectively. The coil spring is fitted in a compressed state between the movable body's surface farthest from to the stationary body and the measuring body on the guide rail. The connecting wall of the movable body and the upper wall of the base have first and second guide holes, respectively, the first and second guide holes aligning with each other in a direction along the guide rail. The measuring body has an auxiliary part protruding upward from the upper surface of the base through the first and second guide holes, the auxiliary part being provided with the measuring surface.

According to still another preferred embodiment of the present invention, the base includes an upper wall and an interior space formed below the upper wall, the upper wall forming the upper surface, the guide rail being attached in the interior space. The movable body includes first and second side walls which form the two surfaces, and a connecting wall connecting upper ends of the first and second side walls to each other, each of the first and second side walls having an opening for inserting the guide rail therethrough. The measuring body has a first through hole for inserting the guide rail therethrough. A rod is arranged in the space of the movable body and attached to both sides of the measurement body and extends between the first and second side walls in parallel with the guide rail, and the measuring body has a second through hole for inserting the rod therethrough. The movable body is arranged in an interior space of the base and the measuring body is arranged in the space of the movable body, the movable body and the measuring body are slidably mounted on the guide rail through the opening and the first through hole, respectively, and the measuring body is slidably mounted on the rod through the second through hole. The coil spring is fitted in a compressed state between the movable body's surface farthest from the stationary body and the measuring body on the rod. The connecting wall of the movable body and the upper wall of the base have first and second guide holes, respectively, the first and second guide holes aligning with each other in a direction along the guide rail. The measuring body has an auxiliary part protruding upward from the upper surface of the base through the first and second guide holes, the auxiliary part being provided with the measuring surface.

According to still another preferred embodiment of the present invention, the second drive mechanism includes: a pair of first pulleys arranged in the interior space of the base and spaced from each other in a direction of an axis of the guide rail, each of the first pulleys having a rotational shaft perpendicular to the axis of the guide rail; a first timing belt extending between the pair of first pulleys, the movable body being fixed to the first timing belt; and a motor arranged in the interior space of the base and coupled to the rotational shaft of one of the first pulley.

According to still another preferred embodiment of the present invention, the travel distance measurement unit includes: a pair of second pulleys arranged in the interior space of the base and spaced from each other in a direction of an axis of the guide rail, each of the second pulleys having a rotational shaft perpendicular to the guide rail; a second timing belt extending between the pair of first pulleys, the measuring body being fixed to the second timing belt; and a conversion unit coupled to the rotational shaft of one of the second pulleys for converting a rotating amount of the one of the second pulleys into the travelling distance of the measuring surface of the measuring body and outputting the travelling distance.

According to still another preferred embodiment of the present invention, a slip inducing plate is attached to each side of the second guide hole on the upper surface of the base and extending in parallel with the second guide hole.

According to still another preferred embodiment of the present invention, the movable body slides toward the stationary body only when the first sensor continues to output a detection signal for a predetermined time.

According to still another preferred embodiment of the present invention, when a detection signal is outputted from the first sensor and a detection signal is outputted from the second sensor, the travel distance measurement unit makes the measurement, in contrast, when a detection signal is outputted from the second sensor and no detection signal is outputted from the first sensor, the travel distance measurement unit does not make the measurement and the movable body slides away from the stationary body to an initial position.

According to still another preferred embodiment of the present invention, the travel distance measurement unit makes the measurement when a predetermined time elapses after a detection signal is outputted from the second sensor and the movable body stops.

According to still another preferred embodiment of the present invention, when a thickness of the next book block is measured by the measurement unit during the perfect binding of a previous book block, the first control unit records the measured value of the thickness of the next book block in a memory, and when the previous book block held between the pair of clamp plates arrives at a predetermined position on the conveying path, the gap of the pair of members of the respective binding units located upstream of the previous book block is adjusted based on the recorded value of the thickness and then, the gap between the pair of members of the respective binding units located downstream of the predetermined position is adjusted based on the recorded value of the thickness after passage of the previous book block through the binding unit and then, upon completion of the perfect binding of the previous book block, the gap between the pair of clamp plates is adjusted based on the recorded value of the thickness.

According to still another preferred embodiment of the present invention, the series of binding units consist of at least a milling unit, an adhesive application unit, and a cover attachment unit, and wherein the milling unit includes, as the pair of members, a pair of guide plates for supporting the protruding both sides of the book block during milling a back of the book block, and wherein the cover attachment unit includes, as the pair of members, a pair of nip plates for pressing a cover against the protruding both sides of the book block on attachment of the cover to the back of the book block.

Effect of the Invention

According to the present invention, an operator jogs a book block which consists of a plurality of sheets or signatures, and, while he (or her) places and supports the book block in a standing position in front of the reference surface of the stationary body with his (or her) hands, the movable body automatically moves and the thickness of the book block is measured in a short time. Furthermore, even though the book block is thick, the book block is not loosed on the measurement because the book block can be firmly supported by the operator's hands, so that the operator need not restart the measurement and the operator's labor is reduced. According to the present invention, especially in manufacturing various kinds of bound products in small quantities, the high productivity can be achieved.

In addition, since the book block is constantly pressed by the measuring surface of the movable body against the reference surface of the stationary body at a constant pressure, even though the book block is thick, air is sufficiently removed from the book block on the measurement, so that the accuracy of the measurement and the quality of the bound product are improved.

BRIEF DESCRIPTION OF THE DRAWINGS

FIG. 3A is a perspective view of the thickness measurement unit, and FIG. 3B is a perspective view similar to FIG. 3A, showing the thickness measurement unit without a base.

FIG. 6A is a perspective view of the thickness measurement unit without a base as viewed from above, and FIG. 6B is a perspective view of the thickness measurement unit without a base as viewed from below, and FIG. 6C is a perspective view of a measuring body of the thickness measurement unit.

FIG. 8A is a plan view, and FIG. 8B is an elevation view.

BEST MODE FOR CARRYING OUT THE INVENTION

Figure 1:
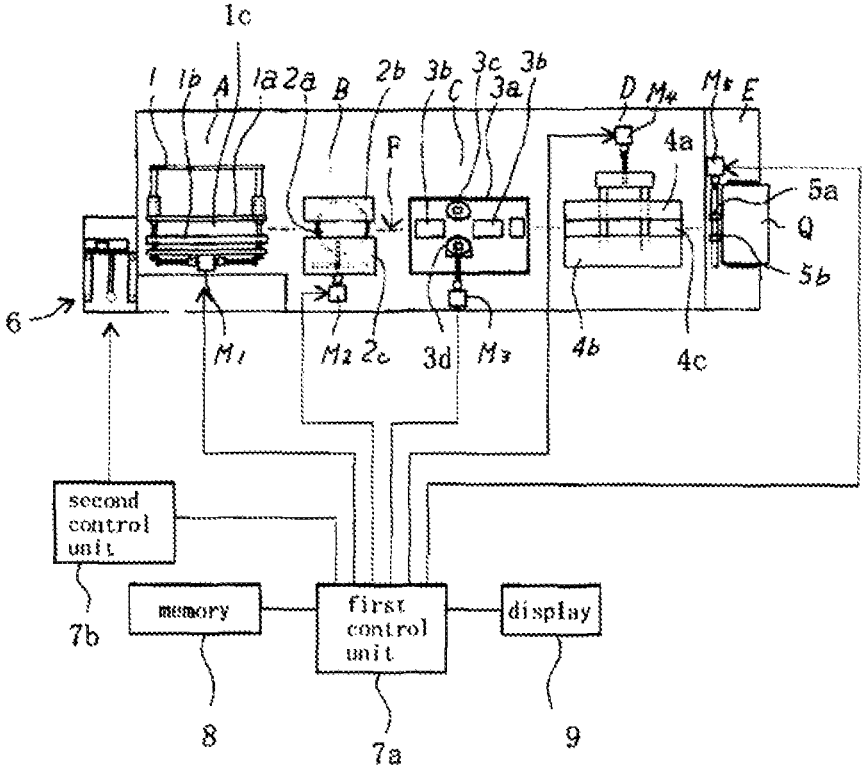
FIG. 1 is a plan view schematically showing a perfect binding machine in accordance with one embodiment of the present invention.
Figure 2:
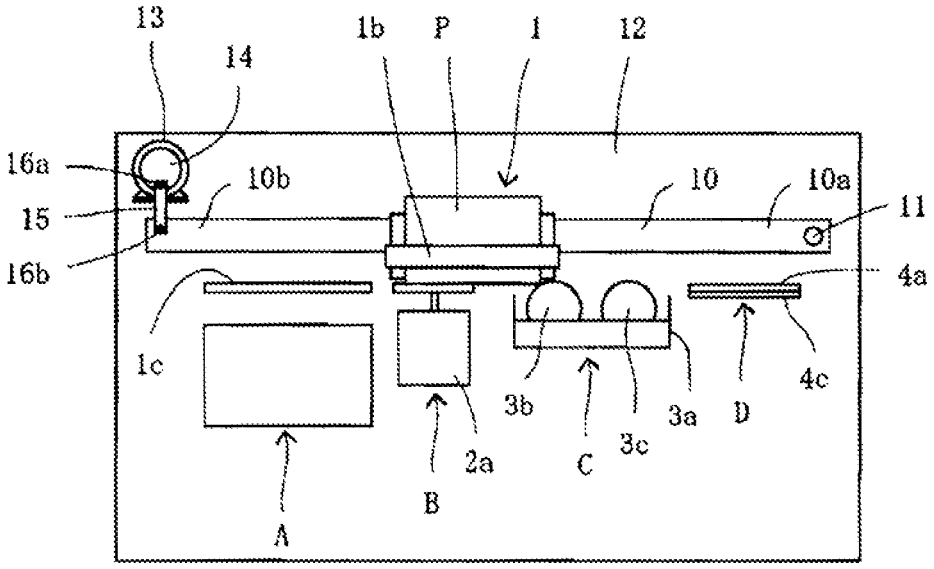
FIG. 2 is a side view of the perfect binding machine shown in FIG. 1.

A preferred embodiment of the present invention will be described below with reference to accompanying drawings. FIG. 1 is a plan view schematically showing a perfect binding machine in accordance with one embodiment of the present invention, and FIG. 2 is a side view of the perfect binding machine shown in FIG. 1. As shown in FIG. 1, the perfect binding machine of the present invention includes a conveying path F, a series of binding units (a milling unit B, an adhesive application unit C, and a cover attachment unit D) which are arranged along the conveying path F and perform perfect binding, a single clamp unit 1 arranged for reciprocal movement along the conveying path F, and a first drive mechanism moving the clamp unit 1 along the conveying path F.

In FIGS. 1 and 2, the alphabet A represents a book block insertion position at which a book block (not shown), which consists of a plurality of sheets or signatures, is inserted and held between a pair of clamp plates 1*a*, 1*b* of the clamp unit 1 in such a manner that a back of the book block faces downwardly. An alignment plate 1*c* is arranged at the book block insertion position A and the book block is supported by the alignment plate 1*c* at its back when the book block is held between the pair of clamp plates 1*a*, 1*b*. The alphabet E represents a cover feeding unit for feeding a cover Q to the cover attachment unit D.

The first drive mechanism is arranged above the binding units B-D and provided with a guide rail 10 extending along the conveying path F. Although not shown, the guide rail 10 includes an endless chain which extends along the guide rail 10 and rotates.

The clamp unit 1 is slidably mounted on the guide rail 10 and fixed to the endless chain so as to reciprocate along the conveying path F with the rotation of the endless chain.

The guide rail 10 is attached to a frame 12 of the binding machine at its one end 10*a* which is positioned on the side of the cover attachment unit D in such a way that the guide rail 10 can swing around a pivot shaft 11 fixed to the frame 12. A motor 13 is arranged on the side of the other end 10*b* of the guide rail 10 and fixed to the frame 12. A rotating plate 14 is fixed to a drive shaft of the motor 13. A rod 15 is pivotally attached to an outer periphery of the rotating plate 14 at its one end through a pin 16*a*, and pivotally attached to the other end 10*b* of the guide rail 10 at its other end through a pin 16*b*.

With a vertical movement of the rod 15 by drive of the motor 13, the guide rail 10 swings around the pivot shaft 11 between a first position at which the guide rail 10 horizontally extends along the conveying path F and a second position at which the guide rail 10 tilts to retreat upward from the binding units B-D.

The pair of clamp plates 1*a*, 1*b* of the clamp unit 1 consists of a stationary clamp plate 1*a* and a movable clamp plate 1*b*. The movable clamp plate 1*b* is moved in directions toward and away from the stationary clamp plate 1*a* by a motor M1 provided in the clamp unit 1.

The guide rail is arranged at the first position, and at the book block insertion position A, the book block is placed on the alignment plate 1*c* in such a manner that a back of the book block faces downwardly and then, held between the pair of clamp plates 1*a*, 1*b*. In this case, the book block is arranged in such a way that both sides of the book block protrude downward from the pair of clamp plates 1*a*, 1*b*. Then the perfect binding is performed while the book block held by the clamp unit 1 sequentially passes through the series of binding units B-D.

On completion of the process by the cover attachment unit D, the guide rail 10 swings from the first position to the second position and the clamp unit 1 is moved back to the book block insertion position A along the guide rail 10, where the book block with the cover Q is discharged from the pair of clamp plates 1*a*, 1*b*.

The milling unit B includes a milling cutter 2*a* and a pair of parallel guide plates 2*b*, 2*c*. The pair of guide plates 2*b*, 2*c* consists of a stationary guide plate 2*b* and a movable guide plate 2*c*. The movable guide plate 2*c* is driven by a motor M2 provided in the milling unit B to move in directions toward and away from the stationary guide plate 2*b*, so that a gap between the pair of guide plates 2*b*, 2*c* can be adjusted.

Prior to start of the perfect binding, the gap between the pair of guide plates 2*b*, 2*c* is adjusted in such a way that the gap is adapted to a thickness of the book block. After the start of the perfect binding, while the book block passes the milling cutter 2*a*, the both sides of the book block protruding from between the pair of clamp plates 1*a*, 1*b*, are passed between the pair of guide plates 2*b*, 2*c*.

In this manner, the back of the book block is cut while the book block is supported by the pair of guide plates 2*b*, 2*c* at its both sides so as to perform pretreatment for uniformly applying an adhesive all over the back of the book block. After that, the book block is conveyed to the adhesive application unit C by the pair of clamp plates 1*a*, 1*b*.

The adhesive application unit C has an adhesive tank 3*a* for storing the adhesive, an adhesive applying roller 3*b* for applying the adhesive to the back of the book block, pair of laterally adhesive applying rollers 3*c*, 3*d* for applying the adhesive to an area of both sides adjacent to the back of the book block, and a roller 3*e* for wiping off the excessive adhesive on the book block. The pair of laterally adhesive applying rollers 3*c*, 3*d* consists of a stationary laterally adhesive applying roller 3*c* and a movable laterally adhesive applying roller 3*d*. The movable laterally adhesive applying roller 3*d* can be driven by a motor M3 to move in directions toward and away from the stationary laterally adhesive applying roller 3*c*.

Prior to start of the perfect binding, a gap between the pair of laterally adhesive applying rollers 3*c*, 3*d* is adjusted in such a way that the gap is adapted to the thickness of the book block. While the book block passes the adhesive tank 3*a*, the pair of laterally adhesive applying rollers 3*c*, 3*d* engages with the area of both sides adjacent to the back of the book block to apply the adhesive to the area of the book block.

On completion of the adhesive application, the book block is conveyed to the cover attachment unit D by the pair of clamp plates 1*a*, 1*b*.

The cover attachment unit D includes a bottom plate 4*c* and a pair of nip plates 4*a*, 4*b*. The pair of nip plates 4*a*, 4*b* consists of a stationary nip plate 4*b* and a movable nip plate 4*a*. The movable nip plate 4*a* can be driven by a motor M4 provided in the cover attachment unit D so as to move in directions toward and away from the stationary nip plate 4, thereby a gap between the pair of nip plates 4*a*, 4*b* can be adjusted.

Prior to start of the perfect binding, the gap between the pair of nip plates 4*a*, 4*b* is adjusted in such a way that the gap is adapted to the thickness of the book block.

The cover feeding unit E includes a tray on which the cover Q is placed, and a cover conveying mechanism for conveying the cover Q from the tray to the bottom plate 4*c* and the pair of nip plates 4*a*, 4*b* of the cover attachment unit D.

The cover conveying mechanism has a pair of crease forming rollers 5*a*, 5*b* for forming creases at predetermined positions of the cover Q. The pair of crease forming rollers 5*a*, 5*b* consists of a stationary crease forming roller 5*a* and a movable crease forming roller 5*b*. The movable crease forming roller 5*b* is driven by a motor M5 so as to move in directions toward and away from the stationary crease forming roller 5*a*, thereby a gap between the pair of crease forming rollers 5*a*, 5*b* can be adjusted in such a way that the gap is adapted to the thickness of the book block.

When the perfect binding is started, the cover Q is conveyed from the cover feeding unit E to the bottom plate 4*c* and the pair of nip plates 4*a*, 4*b* of the cover attachment unit D by the cover conveying mechanism. During the conveying the cover Q, the pair of crease forming rollers 5*a*, 5*b* form two parallel creases at the predetermined positions of the cover Q.

After that, the clamp unit 1 with the book block stops at a position where the back of the book block is opposed to a back of the cover Q (an area between the two parallel creases on the cover Q). Then, the bottom plate 4*c* and the pair of nip plates 4*a*, 4*b* rise, and the cover Q is pressed against the back of the book block by the rising bottom plate 4*c* and at the same time, and the movable nip plate 4*a* is moved toward the stationary nip plate 4*b* and the cover Q is pressed against the both sides the book block, so that the cover Q is adhered to the book block P and to a bound product is manufactured.

In this embodiment, the conveying path is linear and the single clamp unit reciprocates along the conveying path. In another preferred embodiment, the conveying path is in the form of a loop, and a plurality of clamp units circulate on the conveying path in one direction at regular intervals. The series of binding units performs the binding during this circulation movement of the clamps.

Figure 3:
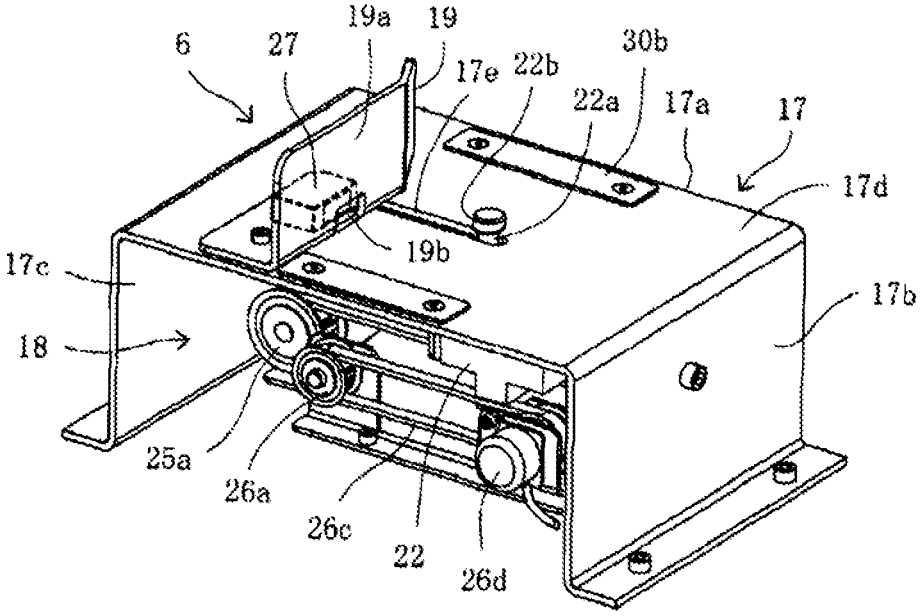
FIGS. 3A and 3B are views showing a thickness measurement unit of the perfect binding machine shown in FIG. 1.
Figure 3:
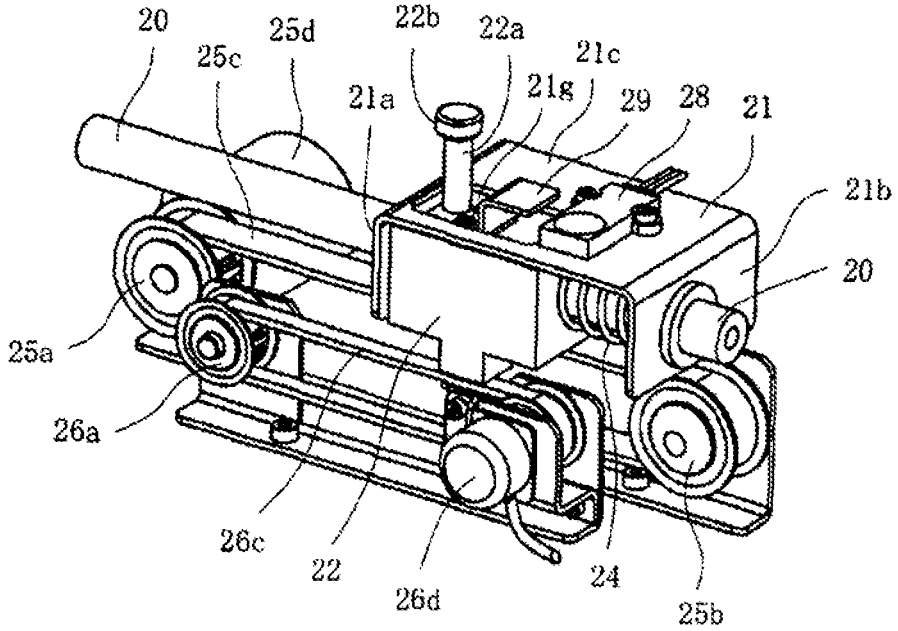
Figure 4:
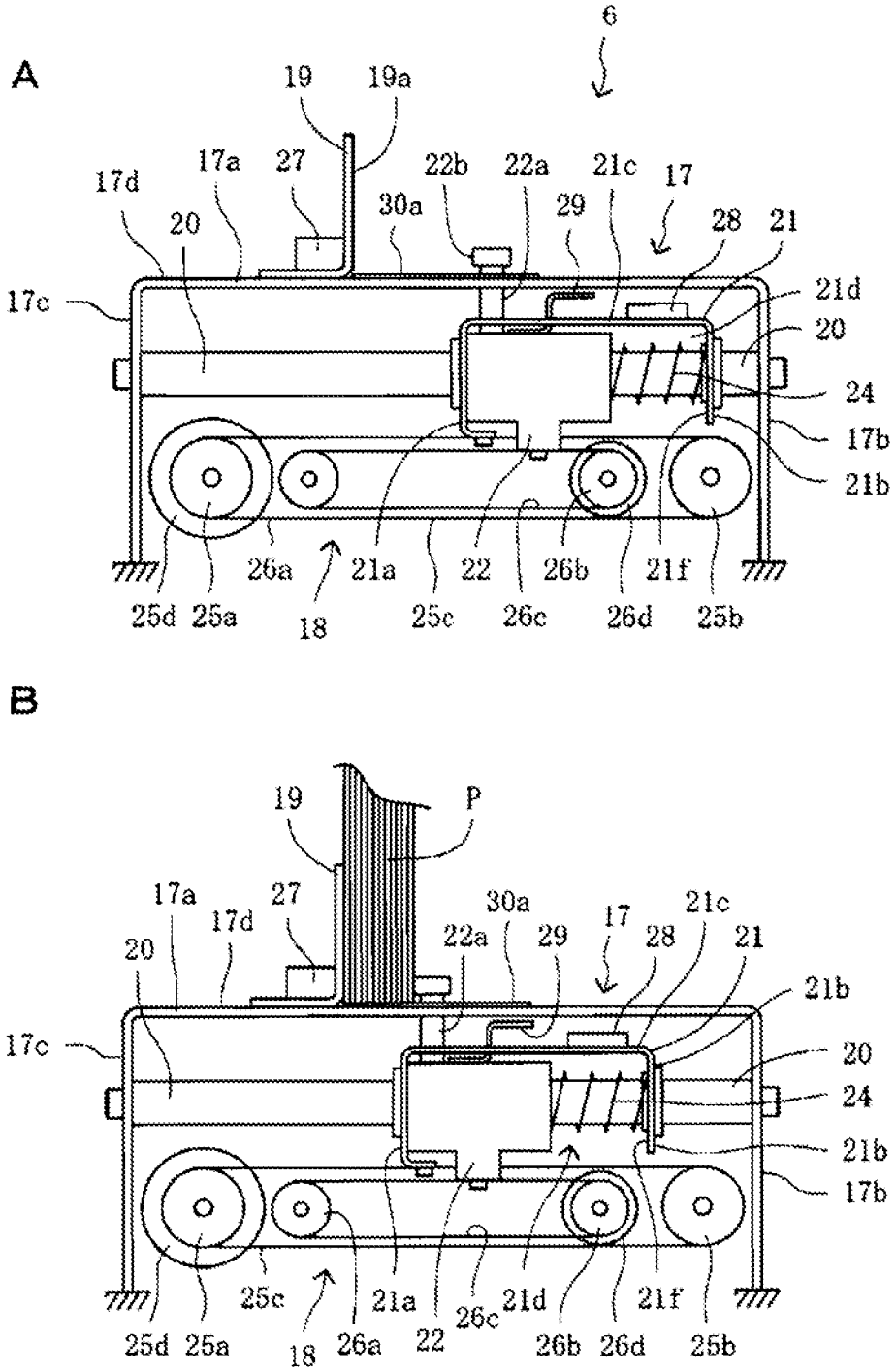
FIGS. 4A and 4B are schematic side views illustrating the operation of the thickness measurement unit shown in FIG. 3.
Figure 5:
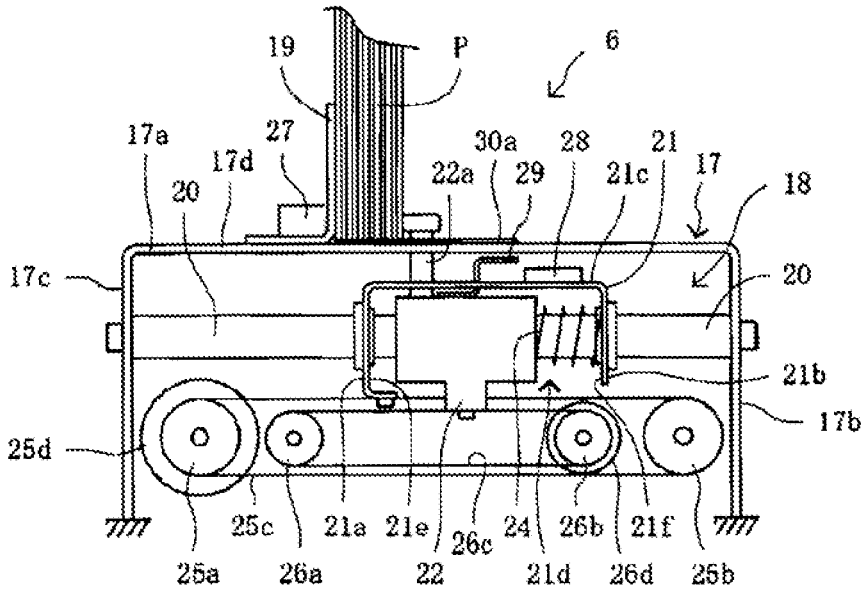
FIGS. 5A and 5B are schematic side views illustrating the operation of the thickness measurement unit shown in FIG. 3.
Figure 5:
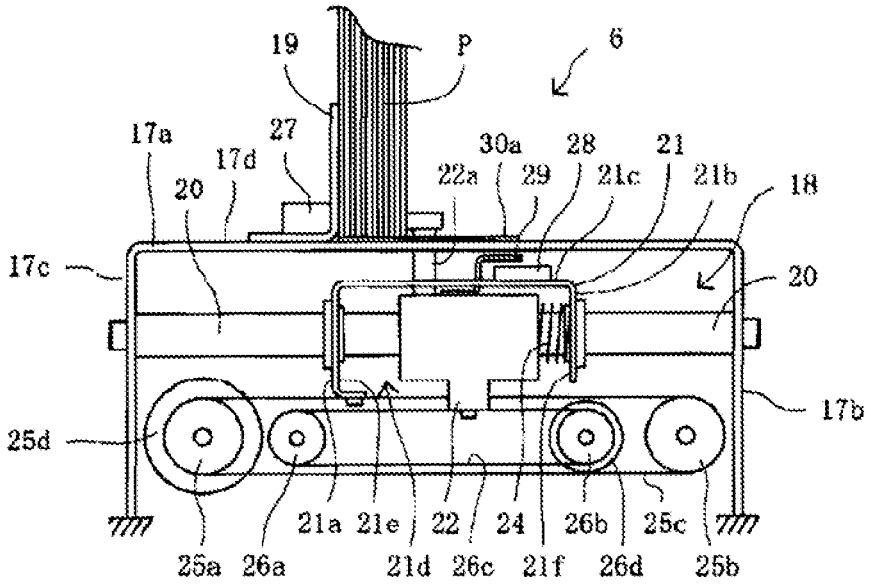

According to the present invention, the perfect binding machine further comprises a thickness measurement unit 6 for measuring the thickness of the book block. FIG. 3A is a perspective view of the thickness measurement unit, and FIG. 3B is a view similar to FIG. 3A, showing the thickness measurement unit without a base. FIGS. 4 and 5 are schematic side views illustrating the operation of the thickness measurement unit shown in FIG. 3.

Referring to FIGS. 3, 4 and 5, the thickness measurement unit 6 includes a base 17 having an upper surface 17*d* on which the book block P is placed. The base 17 has an upper wall 17*a* forming the upper surface 17*d* and side walls 17*b*, 17*c* which are connected to both sides of the upper wall 17*a* and serve as legs. An interior space 18 is formed below the upper wall 17*a*.

A stationary body 19 is attached to the upper surface 17*d* of the base 17. The stationary body 19 has a reference surface 19*a* perpendicular to the upper surface 17*d*. In this embodiment, the stationary body 19 is formed of a plate bent into a substantially L shape, and one flat portion thereof is attached to the upper surface 17*d*, while the other flat portion thereof stands perpendicularly to the upper surface 17*d* to form the reference surface 19*a*.

A guide rail 20 is arranged in the interior space 18 of the base 17 and extends perpendicularly to the reference surface 19*a*.

The thickness measurement unit 6 includes a movable body 21 slidably mounted on the guide rail 20 to move directions toward and away from the stationary body 19.

The movable body 21 has a first side wall 21*a* and a second side wall 21*b* spaced from each other in an axial direction of the guide rail 20, and a connecting wall 21*c* connecting upper ends of the first and second walls 21*a*, 21*b* to each other. A space 21*d* is formed between the first and second walls 21*a*, 21*b*.

A measuring body 22 is arranged in the space 21*d* of the movable body 21 and slidably mounted on the guide rail 20 to move between the two side walls 21*a*, 21*b* (surfaces 21*e*, 21*f*).

Each of the first and second walls 21*a*, 21*b* of the movable body 21 is provided with an opening for inserting the guide rail 20 therethrough. The measuring body 22 has a through hole for inserting the guide rail 20 therethrough. The movable body 21 is arranged in the interior space 18 of the base 17 and the measuring body 22 is arranged in the space 21*d* of the movable body 21, and the movable body 21 and the measuring body 22 are slidably mounted on the guide rail 20 through the opening and the through hole.

A coil spring 24 is fitted in a compressed state between the surface 21*f* of the second side wall 21*b* of the movable body 21 (surface farthest from the stationary body 19) and the measuring body 22 on the guide rail 20 in such a way that the measuring body 22 is constantly pressed against the surface 21*e* of the first side wall 21*a* of the movable body 21 (surface closest to the stationary body 19). In this case, in place of the coil spring 24, well-known appropriate elastic biasing member behaving according to the Hooke's Law can be used.

The connecting wall 21*c* of the movable body 21 and the upper wall 17*a* of the base 17 have first and second guide holes 21*g*, 17*e*, respectively. The first and second guide holes 21*g*, 17*e* align with each other in a direction along the guide rail 20. In this case, one end of the first guide hole 21*g* of the movable body 21 is located at a position where the measuring body 22 is not prevented from contacting the surface 21*e* of the first side wall 21*a* of the movable body 21, and one end of the second guide hole 17*e* of the base 17 is located at a position where a measuring surface 22*b* of the measuring body 22 is not prevented from contacting the reference surface 19*a* of the stationary body 19.

The measuring body 22 has an auxiliary part 22*a* protruding upward from the upper surface 17*d* of the base 17 through the first and second guide holes 21*g*, 17*e*. The auxiliary part 22*a* has the measuring surface 22*b* opposed to the reference surface 19*a* of the stationary body 19.

The thickness measurement unit 6 includes a second drive mechanism for sliding the movable body 21.

In this embodiment, the second drive mechanism includes a pair of first pulleys 25*a*, 25*b* arranged in the interior space 18 of the base 17 and spaced from each other in a direction of an axis of the guide rail 20. Each of the pair of first pulleys 25*a*, 25*b* has a rotational shaft perpendicular to the axis of the guide rail 20.

The second drive mechanism includes a first timing belt 25*c* extending between the pair of first pulleys 25*a*, 25*b*. The movable body 21 is fixed to the first timing belt 25*c*.

The second drive mechanism further includes a motor 25*d* arranged in the interior space 18 of the base 17 and coupled to a rotational shaft of the first pulley 25*a*.

Thus the rotation of the first pulley 25*a* by the motor 25*d* effects the slide movement of the movable body 21.

The thickness measurement unit 6 further includes travel distance measurement unit measuring a travelling distance of the measuring surface 22*b* from the reference surface 19*a*. In this case, a zero point of the travelling distance is established as a point at which the measuring surface 22*b* of the measuring body 22 contacts the reference surface 19*a* of the stationary body 19.

In this embodiment, the travel distance measurement unit includes a pair of second pulleys 26*a*, 26*b* arranged in the interior space 18 of the base 17 and spaced from each other in a direction of the axis of the guide rail 20. Each of the pair of second pulleys 26*a*, 26*b* has a rotational shaft perpendicular to the axis of the guide rail 20.

The travel distance measurement unit includes a second timing belt 26*c* extending between the pair of second pulleys 26*a*, 26*b*. The measuring body 22 is fixed to the second timing belt 26*c*.

The travel distance measurement unit further includes a conversion unit 26*d* coupled to the rotational shaft of the second pulley 26*b* and converts the rotation amount of the second pulley 26*b* into the travelling distance of the measuring surface 22*b* of the measuring body 22 and outputs the travelling distance. In this embodiment, the conversion unit 26*d* is a rotary encoder.

The second drive mechanism and the travel distance measurement unit are controlled by a second control unit 7*b*.

The thickness measurement unit 6 further includes a first sensor 27 attached to the base 17 or the stationary body 19 so as to detect a time when the book block P is placed in front of the reference surface 19*a* of the stationary body 19. In this embodiment, the first sensor 27 consists of a photoelectric sensor and is attached to the one flat portion of the stationary body 19 in such a manner that the first sensor 27 is directed to the other standing flat portion of the stationary body 19. The other standing flat portion has a detection window 19*b* at a position corresponding to the first sensor 27.

When the book block P is placed in front of the reference surface 19*a*, light directed to the first sensor 27 is blocked so that the first sensor 27 outputs a detection signal.

The thickness measurement unit 6 includes a second sensor 28 attached to the movable body 21 or the measuring body 22 or the both so as to detect a time when the measuring body 22 is separated from the surface 21*e* of the first side wall 21*a* of the movable body 21 (surface closest to the stationary body) by a predetermined distance against an elastic force of the coil spring 24. In this embodiment, the second sensor 28 consists of a proximity sensor and is attached to an upper surface of the connecting wall 21*c* of the movable body 21 in such a manner that the second sensor 28 faces upwardly. A metal plate 29 as a counterpart of the second sensor 28 is attached to an upper surface of the measuring body 22. The metal plate 29 comes close to and is detected by the second sensor 28 when the measuring body 22 is separated from the surface 21*e* of the movable body 21 by the predetermined distance.

Slip inducing plates 30*a*, 30*b* are fixed to both sides of the second guide hole 17*e* in the upper surface 17*d* of the base 17 and extend in parallel with a second guide hole 17*e*.

The operation of the thickness measurement unit 6 is as follows.

Prior to start of the measurement, the movable body 21, that is, its measuring surface 22*b* is located at an initial position separated from the reference surface 19*a* of the stationary body 19 to a maximum extent (See also FIG. 4A).

After a book block P is jogged on an appropriate flat surface of the binding machine by an operator, the book block P is placed in front of the reference surface 19*a* to interrupt the first sensor 27 and supported in a standing state with hands of the operator. At this time, the first sensor 27 detects the book block P and outputs the detection signal. The second control unit 7*b* receives the detection signal from the first sensor 27 and triggers the second drive mechanism, thereby the movable body 21 starts to slide toward the stationary body 19.

In this case, preferably, in order to prevent the thickness measurement unit from being triggered by unintentional interruption of the first sensor 27, the movable body 21 starts to slide only when the output of the detection signal from the first sensor 27 continues for a predetermined time.

During the slide movement of the movable body 21, the book block P is pushed toward the reference surface 19*a* by the measuring surface 22*b* of the measuring body 22 until the book block P is nipped between the reference surface 19*a* and the measuring surface 22*b* (See also FIG. 4B). In this case, with the help of the slip inducing plates 30*a*, 30*b*, even if the book block is thick, it is smoothly pushed.

At this position, the measuring body 22 cannot further move toward the stationary body 19 due to the intervention of the book block P between the reference surface 19*a* and the measuring surface 22*b*. On the contrary, the movable body 21 continues to slide. Thus, the measuring body 22 is gradually separated from the surface 21*e* of the first side wall 21*a* of the movable body 21 with compression of the coil spring 24 (See also FIG. 5A).

When the measuring body 22 is separated from the surface 21*e* of the movable body 21 by the predetermined distance, the metal plate 29 of the measuring body 22 is detected by the second sensor 28 of the movable body 21 and the second sensor 28 outputs a detection signal. The second control unit 7*b* receives the detection signal from the second sensor 28 and stops the second drive mechanism, thereby the movable body 21 is stopped. At this time, the thickness of the book block P is measured by the travel distance measurement unit (See also FIG. 5B). Data of the measured value is transmitted to the second control unit 7*b*.

In this manner, at the time of measurement, the book block P is pressed against the reference surface 19*a* of the stationary body 19 by the measuring surface 22*b* of the measuring body 22 at a constant pressure. In this case, the magnitude of the pressure applied to the book block P can be adjusted by changing the distance between the measuring body 22 and the surface 21*e* of the movable body 21 at the time of stoppage of the movable body 21.

Preferably, in order to avoid a mistake of measurement, when a detection signal is outputted from the first sensor 27 and a detection signal outputted from the second sensor 28, the travel distance measurement unit makes the measurement, on the other hand, when a detection signal is outputted from the second sensor 28 and no detection signal is outputted from the first sensor 27, the travel distance measurement unit does not make the measurement and the movable body 21 slides away from the stationary body 19 to an initial position.

It is preferred that the travel distance measurement unit makes the measurement when a predetermined time elapses after a detection signal is outputted from the second sensor 27 and the movable body 21 is stopped. Consequently, even if a book block P is thick, air is sufficiently removed from the book block P on the measurement, so that the accuracy of the measurement is improved.

According to the present invention, an operator jogs a book block P and, while he (or her) places and supports the book block P in front of the reference surface 19*a* of the stationary body 19 with his (or her) hands, the movable body 21 automatically moves and the thickness of the book block P is measured in a short time. Furthermore, even though the book block P is thick, the book block P is not loosed on the measurement because the book block P can be firmly supported by the operator's hands, and consequently, the operator need not restart the measurement and the operator's labor is reduced. Especially, in manufacturing various kinds of bound products in small quantities, the present invention results in higher productivity than ever before.

In addition, since the book block P is pressed against the reference surface 19*a* of the stationary body 19 at a constant pressure by the measuring surface 22*b* of the measuring body 22 at measurement, even when the book block P is thick, sufficient air vent is achieved, thereby improving the measurement accuracy and the finished quality of the bound product.

According to the present invention, the perfect binding machine further comprises a first control unit 7*a* controlling the motor M1 of the clamp unit 1, the motor M2 of the milling unit B, the motor M3 of the adhesive application unit C, the motor M4 of the cover attachment unit D, and the motor M5 of the cover feeding unit E, a memory 8, and a display 9. Then, data is transmitted between the first and second control unit 7*a*, 7*b*.

Prior to start of the perfect binding, when the thickness of the book block P is measured by the thickness measurement unit 6, data of the measured value is transmitted from the second control unit 7*b* to the first control unit 7*a*, and the measured value is displayed on the display 9. Before the book block P is held by the clamp unit, the gap between the pair of clamp plates 1*a*, 1*b*, the gap between the pair of guide plates 2*b*, 2*c* of the milling unit B, the gap between the pair of laterally adhesive applying rollers 3*c*, 3*d* of the adhesive application unit C, the gap between the pair of nip plates 4*a*, 4*b* of the cover attachment unit D, and the gap between the pair of crease forming rollers 5*a*, 5*b* of the cover feeding unit E are adjusted by the control unit 7 based on the measured value of the thickness in such a way that these gaps are adapted to the thickness of the book block P.

When a thickness of the next book block P is measured by the thickness measurement unit 6 during the perfect binding of the previous book block P, the first control unit 7*a* records the measured value of the thickness of the next book block P in the memory 8. Then, when the previous book block P held between the pair of clamp plates 1*a*, 1*b* arrives at a predetermined position on the conveying path F, the gaps between the pairs of members of the respective binding units B-E located upstream of the previous book block P is adjusted based on the recorded value of the thickness. After that, the gap between the pairs of members of the respective binding units B-E located downstream of the predetermined position is adjusted based on the recorded value of the thickness after passage of the previous book block P through the binding unit and then, upon completion of the perfect binding of the previous book block P, the gap between the pair of clamp plates 1*a*, 1*b* is adjusted based on the recorded value of the thickness.

In this case, a rotary encoder is coupled to one of a pair of sprockets rotating the endless chain of the first drive mechanism. Then, when the clamp unit 1 departs from the book block insertion position A after clamping the book block P, a conveyance start signal is outputted from the clamp unit 1 or a sensor which is arranged at the book block insertion position A. When the conveyance start signal is received by the control unit 7, the control unit 7 starts to count the number of pulses outputted from the rotary encoder to detect a distance of conveyance of the book block P. When the distance of conveyance of the book block P reaches the predetermined value, the control unit 7 detects an arrival of the book block P at the predetermined position. In this embodiment, the control unit 7 detects an arrival of the book block P at the cover attachment unit D as the arrival at the predetermined position.

Although the present invention has been described with reference to one or more specific embodiments, it will be understood that the present invention is not limited to them and various modifications to this invention can be easily made by those skilled in the art within the scope of the appended claims.

FIGS. 6A to 6C are views showing a thickness measurement unit according to another embodiment of the present invention. FIG. 6A is a perspective view of the thickness measurement unit without a base as viewed from above, FIG. 6B is a perspective view of the thickness measurement unit without the base as viewed from below, and FIG. 6C is a perspective view of a measuring body of the thickness measurement unit.

Figure 6:
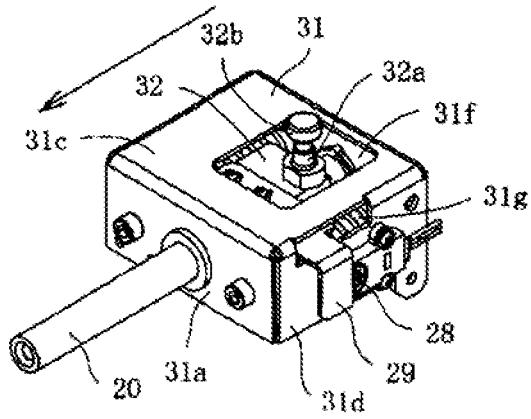
FIGS. 6A, 6B and 6C are views showing a thickness measurement unit in accordance with another embodiment of the present invention.
Figure 6:
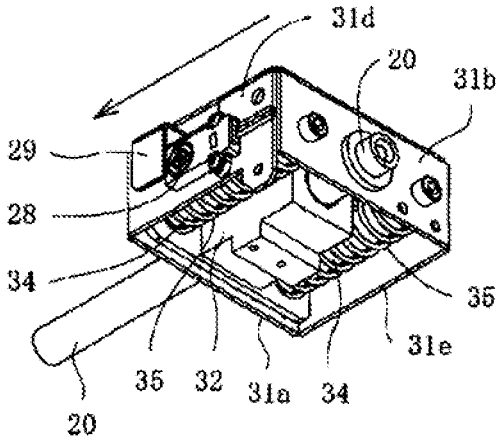
Figure 6:
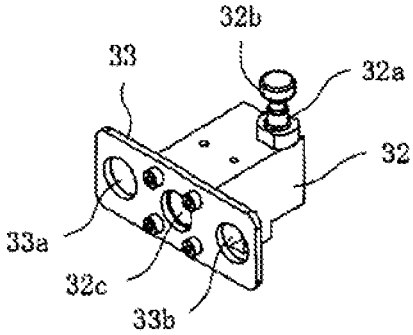
Figure 7:
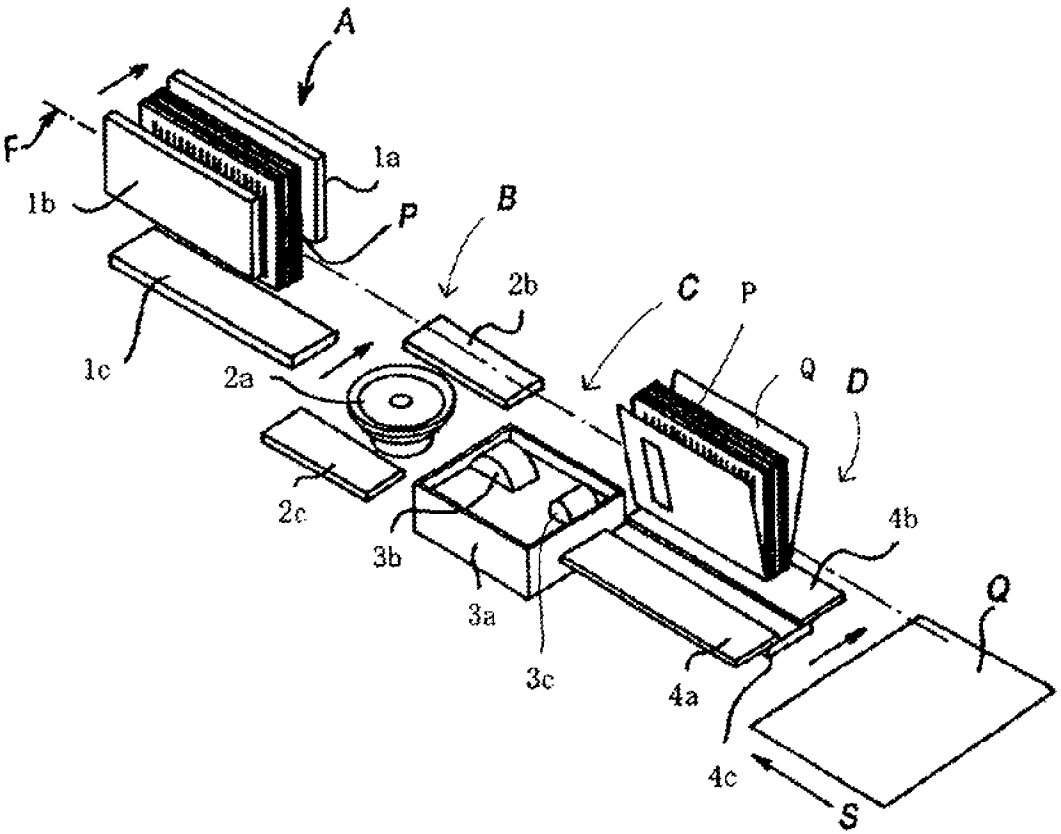
FIG. 7 is a perspective view schematically showing a conventional perfect binding machine.
Figure 8:
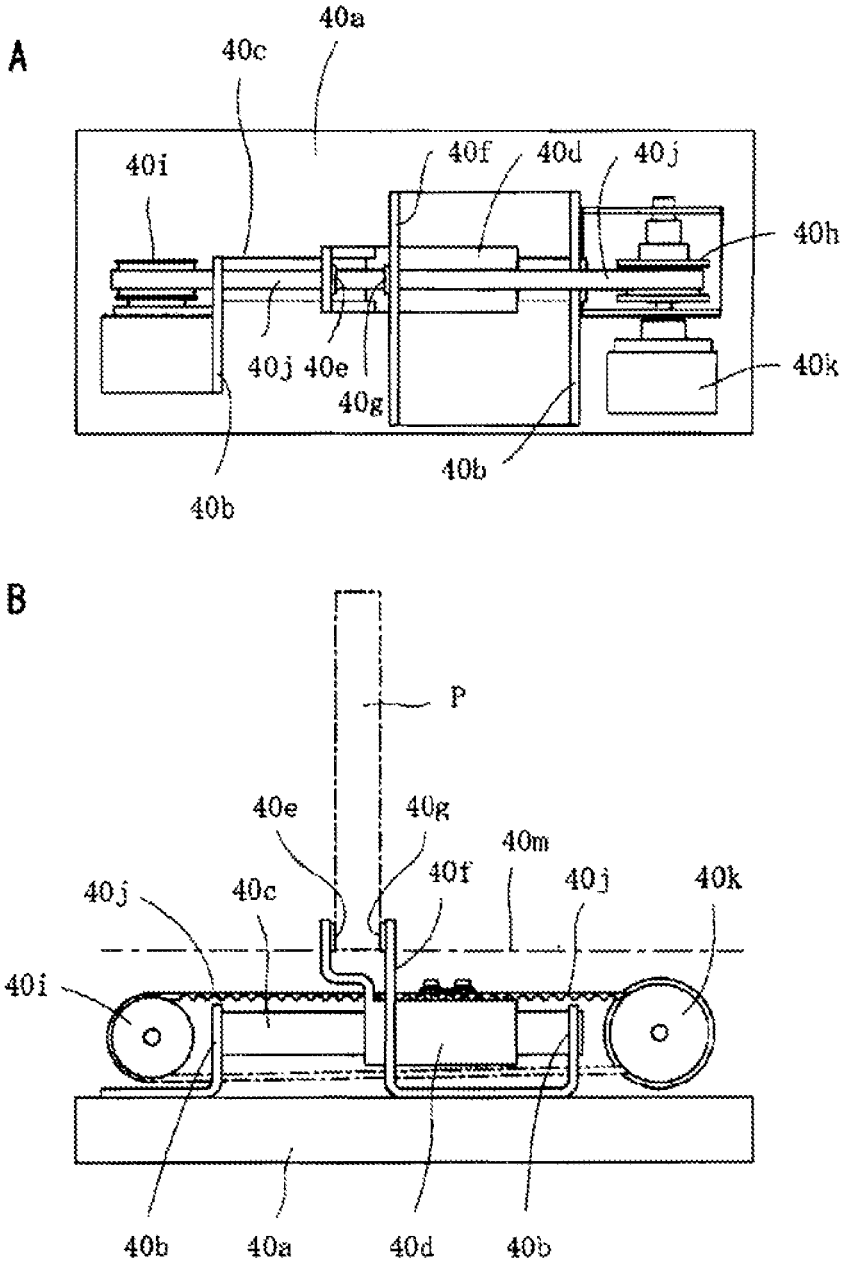
FIGS. 8A and 8B are views showing a thickness measurement unit of the perfect binding machine shown in FIG. 7.

The embodiment shown in FIG. 6 is different from the embodiment shown in FIGS. 1 to 5 only in the movable body and the measuring body of the thickness measurement unit. Therefore, the same reference numerals are assigned to the same structural elements as those shown in FIGS. 1 to 5 and the details thereof are omitted.

Referring to FIG. 6, in this embodiment, a movable body 31 is in the form of a hollow rectangular parallelepiped without a bottom wall and has an upper wall 31*c*, opposed first and second side walls 31*a*, 31*b*, and opposed third and fourth side walls 31*d*, 31*e*.

The first and second side walls 31*a*, 31*b* have an opening for inserting the guide rail 20 therethrough, respectively.

A measuring body 32 has a rectangular auxiliary plate 33 on an end surface opposed to the first side wall 31*a* of the movable body 31. The auxiliary plate 33 is smaller than the first side wall 31*a*. The measuring body 32 has a first through hole 32*c* for inserting the guide rail 20 therethrough.

In a space of the movable body 31, a rod 34 is arranged at each side of the measuring body 32 and extends between the first and second side walls 31*a*, 31*b* in parallel with the guide rail 20. Second through holes 33*a*, 33*b* are formed at both sides of the auxiliary plate 33 of the measuring body 32 and the rod 34 is inserted into the second through holes 33*a*, 33*b*.

The movable body 31 is arranged in the interior space 18 of the base 17 and the measuring body 32 is arranged in the space of the movable body 31. The movable body 31 and the measuring body 32 are slidably mounted on the guide rail 20 through the opening and the first through hole 32*c*, respectively and the measuring body 32 is slidably mounted on the rods 34 through the second through holes 33*a*, 33*b*.

Coil springs 35 are fitted in a compressed state between a surface of the second side wall 31*b* of the movable body 31 (surface farthest from the stationary body 19) on the rods 34 and the auxiliary plate 33 of the measuring body 32. Thus the measuring body 32 (auxiliary plate 33) is constantly pressed against the surface of the first side wall 31*a* of the movable body 31 (surface closer to the stationary body 19) by an elastic force of the coil springs 35.

The upper wall 31*c* of the movable body 31 and the upper wall 17*a* of the base 17 have first and second guide holes 31*f*, 17*e*, respectively. The first and second guide holes 31*f*, 17*e* align with each other in a direction along the guide rail 20. The measuring body 32 has an auxiliary part 32*a* extending upward from the upper surface 17*d* of the base 17 through the first and second guide holes 31*f*, 17*e*, and the auxiliary part 32*a* has a measuring surface 32*b*.

The second sensor (proximity sensor) 28 is attached to the third side wall 31*d* of the movable body 31 in such a manner that the second sensor 28 faces outwardly, and an upper part of the third side wall 31*d* has a slot 31*g* extending along the guide rail 20. The metal plate 29 is attached to the upper surface of the measuring body 32 and protrudes outward through the slot 31*g*. With the motion of the measuring body 32 with respect to the movable body 31, the metal plate 29 moves along the slot 31*g*. Then, when the measuring body 32 (auxiliary plate 33) is separated from the surface of the first side wall 31*a* of the movable body 31 by a predetermined distance, the metal plate 29 comes close to the second sensor 28 to be detected by the second sensor 28.

In this embodiment, the movable body and the measuring body significantly become compact and further, a sufficient length of the coil springs can be used so that the pressure at the measurement of the thickness can be easily adjusted.

DESCRIPTION OF REFERENCE SIGNS

1 clamp unit
1*a*, 1*b* clamp plate
1*c* alignment plate
2*a* milling cutter
2*b*, 2*c* guide plate
3*a* adhesive tank
3*b* adhesive applying roller
3*c*, 3*d* laterally adhesive applying roller
3*e* roller for wiping off excessive adhesive
4*a*, 4*b* nip plate
4*c* bottom plate
5*a*, 5*b* crease forming roller
6 measurement unit
7*a* first control unit
7*b* second control unit
8 memory
9 display
10 guide rail
11 pivot shaft
12 frame
13 motor
14 rotating plate
15 rod
16*a*, 16*b* pin
17 base
17*a* upper wall
17*b*, 17*c* side wall
17*d* upper surface
17*e* second guide hole
18 interior space
19 stationary body
19*a* reference surface
19*b* detection window
20 guide rail
21 movable body
21*a* first side wall
21*b* second side wall
21*c* connecting wall
21*d* space
21*e*, 21*f* surface
21*g* first guide hole
22 measuring body
22*a* auxiliary part
22*b* measuring surface
24 coil spring
25*a*, 25*b* first pulley
25*c* first timing belt
25*d* motor
26*a*, 26*b* second pulleys
26*c* second timing belt
26*d* rotary encoder
27 first sensor
28 second sensor
29 metal plate
30*a*, 30*b* slip inducing plate
A book block insertion position
B milling unit
C adhesive application unit
D cover attachment unit
E cover feeding unit
F conveying path
P book block
Q cover

The invention claimed is:

1. A perfect binding machine comprising:

a conveying path;

a series of binding units arranged along the conveying path for performing perfect binding;

at least one clamp unit movable along the conveying path;

a first drive mechanism moving the clamp unit along the conveying path, the perfect binding being performed while a book block held between a pair of clamp plates of the clamp unit sequentially passes through the binding units, the respective two or more binding units including a pair of members with which the book block is engaged at both sides thereof protruding from between the pair of clamp plates, and a gap adjusting unit moving the pair of members in directions toward and away from each other;

a first control unit controlling the clamp unit and the gap adjusting unit; and a thickness measurement unit measuring a thickness of the book block, wherein before start of the perfect binding, the thickness of the book block is measured by the thickness measurement unit, and the gap between the pair of clamp plates and the gap of the respective pair of members are adjusted by the first control unit based on the measured value of the thickness, characterized in that the thickness measurement unit includes:

a base having an upper surface on which the book block is placed;

a stationary body attached to the upper surface of the base and having a reference surface perpendicular to the upper surface;

a guide rail attached to the base and extending perpendicularly to the reference surface;

a movable body mounted on the guide rail for slide movement in directions toward and away from the stationary body; and a second drive mechanism sliding the movable body along the guide rail, the movable body having two surfaces which are spaced from each other in a direction of an axis of the guide rail, a space being formed between the two surfaces, the thickness measurement unit further includes:

a measuring body arranged in the space of the movable body and mounted on the guide rail for slide movement between the two surfaces, and having a measuring surface opposed to the reference surface of the stationary body;

one or more elastic biasing members arranged between the movable body and the measuring body for constantly pressing the measuring body against a surface closest to the stationary body of the two surfaces;

a first sensor attached to the base or the stationary body so as to detect a time when the book block is placed in front of the reference surface of the stationary body;

a second sensor attached to the movable body, or the measuring body, or the both so as to detect a time when the measuring body is separated from the surface closest to the stationary body by a predetermined distance against an elastic force of the elastic biasing member;

a travel distance measurement unit measuring a travel distance of the measuring surface from the reference surface, a zero point of the travel distance being established as a point at which the measuring surface of the measuring body contacts the reference surface of the stationary body; and a second control unit controlling the second drive mechanism and the travel distance measurement unit, and that, when the first sensor outputs a detection signal, the movable body further slides toward the stationary body after the measuring surface of the measuring body comes into contact with the book block so as to press the book block against the reference surface and then, when the second sensor outputs a detection signal, the movable body stops and the measurement is performed by the travel distance measurement unit to obtain the thickness of the book block.

2. The perfect binding machine according to claim 1, wherein the elastic biasing member of the thickness measurement unit is a coil spring.

3. The perfect binding machine according to claim 2, wherein the first sensor is a photoelectric sensor, and the second sensor is a proximity sensor.

4. The perfect binding machine according to claim 3, wherein the base includes an upper wall and an interior space formed below the upper wall, the upper wall forming the upper surface, the guide rail being arranged in the interior space, the movable body includes first and second side walls which form the two surfaces, and a connecting wall connecting upper ends of the first and second side walls to each other, each of the first and second side walls having an opening for inserting the guide rail therethrough, the measuring body has a through hole for inserting the guide rail therethrough, the movable body is arranged in the interior space of the base, the measuring body is arranged in the space of the movable body, the movable body and the measuring body are slidably mounted on the guide rail through the opening and the through hole, respectively, the coil spring is fitted in a compressed state between the movable body's surface farthest from to the stationary body and the measuring body on the guide rail, the connecting wall of the movable body and the upper wall of the base have first and second guide holes, respectively, the first and second guide holes aligning with each other in a direction along the guide rail, and the measuring body has an auxiliary part protruding upward from the upper surface of the base through the first and second guide holes, the auxiliary part being provided with the measuring surface.

5. The perfect binding machine according to claim 3, wherein the base includes an upper wall and an interior space formed below the upper wall, the upper wall forming the upper surface, the guide rail being attached in the interior space, the movable body includes first and second side walls which form the two surfaces, and a connecting wall connecting upper ends of the first and second side walls to each other, each of the first and second side walls having an opening for inserting the guide rail therethrough, the measuring body has a first through hole for inserting the guide rail therethrough, a rod is arranged in the space of the movable body and attached to both sides of the measurement body and extends between the first and second side walls in parallel with the guide rail, and the measuring body has a second through hole for inserting the rod therethrough, the movable body is arranged in an interior space of the base and the measuring body is arranged in the space of the movable body, the movable body and the measuring body are slidably mounted on the guide rail through the opening and the first through hole, respectively, and the measuring body is slidably mounted on the rod through the second through hole, the coil spring is fitted in a compressed state between the movable body's surface farthest from the stationary body and the measuring body on the rod, the connecting wall of the movable body and the upper wall of the base have first and second guide holes, respectively, the first and second guide holes aligning with each other in a direction along the guide rail, and the measuring body has an auxiliary part protruding upward from the upper surface of the base through the first and second guide holes, the auxiliary part being provided with the measuring surface.

6. The perfect binding machine according to claim 4, wherein the second drive mechanism includes:

a pair of first pulleys arranged in the interior space of the base and spaced from each other in a direction of an axis of the guide rail, each of the first pulleys having a rotational shaft perpendicular to the axis of the guide rail;

a first timing belt extending between the pair of first pulleys, the movable body being fixed to the first timing belt; and a motor arranged in the interior space of the base and coupled to the rotational shaft of one of the first pulley.

7. The perfect binding machine according to claim 6, wherein the travel distance measurement unit includes:

a pair of second pulleys arranged in the interior space of the base and spaced from each other in a direction of an axis of the guide rail, each of the second pulleys having a rotational shaft perpendicular to the guide rail;

a second timing belt extending between the pair of first pulleys, the measuring body being fixed to the second timing belt; and a conversion unit coupled to the rotational shaft of one of the second pulleys for converting a rotating amount of the one of the second pulleys into the travelling distance of the measuring surface of the measuring body and outputting the travelling distance.

8. The perfect binding machine according to claim 7, wherein a slip inducing plate is attached to each side of the second guide hole on the upper surface of the base and extending in parallel with the second guide hole.

9. The perfect binding machine according to claim 1, wherein the movable body slides toward the stationary body only when the first sensor continues to output a detection signal for a predetermined time.

10. The perfect binding machine according to claim 9, wherein, when a detection signal is outputted from the first sensor and a detection signal is outputted from the second sensor, the travel distance measurement unit makes the measurement, in contrast, when a detection signal is outputted from the second sensor and no detection signal is outputted from the first sensor, the travel distance measurement unit does not make the measurement and the movable body slides away from the stationary body to an initial position.

11. The perfect binding machine according to claim 10, wherein the travel distance measurement unit makes the measurement when a predetermined time elapses after a detection signal is outputted from the second sensor and the movable body stops.

12. The perfect binding machine according to claim 1, wherein when a thickness of the next book block is measured by the measurement unit during the perfect binding of a previous book block, the first control unit records the measured value of the thickness of the next book block in a memory, and when the previous book block held between the pair of clamp plates arrives at a predetermined position on the conveying path, the gap of the pair of members of the respective binding units located upstream of the previous book block is adjusted based on the recorded value of the thickness and then, the gap between the pair of members of the respective binding units located downstream of the predetermined position is adjusted based on the recorded value of the thickness after passage of the previous book block through the binding unit and then, upon completion of the perfect binding of the previous book block, the gap between the pair of clamp plates is adjusted based on the recorded value of the thickness.

13. The perfect binding machine according to claim 1, wherein the series of binding units consist of at least a milling unit, an adhesive application unit, and a cover attachment unit, and wherein the milling unit includes, as the pair of members, a pair of guide plates for supporting the protruding both sides of the book block during milling a back of the book block, and wherein the cover attachment unit includes, as the pair of members, a pair of nip plates for pressing a cover against the protruding both sides of the book block on attachment of the cover to the back of the book block.

* * * * *